US006854669B2

(12) United States Patent
Anthony

(10) Patent No.: US 6,854,669 B2
(45) Date of Patent: Feb. 15, 2005

(54) SPRAYING EQUIPMENT

(76) Inventor: Ian Michael Anthony, 10 Cunningham Road, Hyde Park, Doncaster, South Yorkshire DN1 2BW (GB)

( * ) Notice: Subject to any disclaimer, the term of this patent is extended or adjusted under 35 U.S.C. 154(b) by 63 days.

(21) Appl. No.: 10/257,505

(22) PCT Filed: Mar. 28, 2001

(86) PCT No.: PCT/GB01/01394

§ 371 (c)(1),
(2), (4) Date: Oct. 11, 2002

(87) PCT Pub. No.: WO01/81003

PCT Pub. Date: Nov. 1, 2001

(65) Prior Publication Data

US 2003/0146304 A1 Aug. 7, 2003

(30) Foreign Application Priority Data

Apr. 25, 2000 (GB) ..... 0009788

(51) Int. Cl.[7] ..... B05B 7/02
(52) U.S. Cl. ..... 239/525; 239/324
(58) Field of Search ..... 239/294, 292, 239/324, 525

(56) References Cited

U.S. PATENT DOCUMENTS 1,661,239 A 3/1928 Stephan
5,058,807 A 10/1991 Smith
RE35,769 E * 4/1998 Grime et al. ..... 239/72

FOREIGN PATENT DOCUMENTS

| | | |
|---|---|---|
| FR | 2327821 | 5/1977 |
| GB | 2145014 A | 3/1985 |
| JP | 03226367 | 7/1991 |
| JP | 11128786 | 5/1999 |

* cited by examiner

*Primary Examiner*—Thomas Denion
*Assistant Examiner*—Zelalem Eshete
(74) *Attorney, Agent, or Firm*—Jackson Walker LLP

(57) ABSTRACT

Liquid spraying equipment, for example for paint, adhesives and chemicals, comprises a spray gun (30) having a luid outlet (53) to which liquid is pumped from a container, the outlet being adjaceent a pressurized air or other fluid outlet (34) to entrain the liquid and thereby atomize it. The liquid pump is housed in a separate unit of which a removable liquid container can be sealingly coupled. The unit also contains a pump to deliver pressurized air to a chamber with a hose ocnnection to the spray gun and with a tapping to the liquid container so as to pressurize the liquid and assist the liquid pump to deliver it to the spray gun through a pipe, possibly within the pressurized air hose. The flow of liquid through the outlet is regulated by a pin (38) or the like slidably mounted in a bore (35). A trigger mechanism (36) retracts the pin from the outlet against the force of a restoring spring (40). An adjustable limit stop (49) determines the degree of opening of the liquid outlet. The system is particularly suitable for for viscous material, such as emulsion paints, which cannot readily be drawn into a conventional spray gun.

13 Claims, 2 Drawing Sheets

SPRAYING EQUIPMENT

FIELD OF THE INVENTION

This invention relates to spraying equipment, and in particular to spraying equipment which sprays liquid at high volume and low pressure.

BACKGROUND TO THE INVENTION

In many cases spraying equipment is used to apply paint to surfaces. The types of spraying equipment available are divided into three categories. The first category sprays paint using high volumes of air at low pressures. The second category sprays paint using air at high pressures. The third is airless, relying solely on pressurised paint.

One example of the first category of sprayer has an air supply to which is attached a hose having a gun at the free end thereof. The gun is provided with a trigger mechanism which is arranged to open and close a nozzle mounted in the gun. Around the nozzle there is provided a plurality of holes through which air is expelled. Within this air stream is a region of low pressure. A container holding a supply of paint is attached to the gun. A pipe extends from the gun into the container. Opening the nozzle causes paint to be drawn from the container through the pipe into the gun, and to be expelled from the nozzle.

This type of spraying equipment suffers from a number of drawbacks. Relying on the venturi effect to lift the paint from the container into the gun is satisfactory for some paints, but is not satisfactory where the paints are of high viscosity, such as emulsions. This type of spraying equipment simply cannot provide sufficient lift to draw this type of paint from the container to the gun and subsequently out of the nozzle.

A number of other problems associated with this type of spraying equipment arise from the location of the container. Because the container is carried on the gun itself, which is hand held, the sprayer operator must bear the weight of the paint and the container whilst he is spraying. Clearly, carrying such a weight leads to fatigue in the wrist. This fatigue may result in the sprayer operator taking more rest periods than he would if he did not have to carry such a weight. However, and more seriously, the continued use of such a sprayer could have longer term health risks, such as repetitive strain injury.

The fact that the container is attached to the gun makes the gun/container assembly a larger object then the gun alone. This makes it difficult to spray paint in corners or other concealed areas. Additionally, when spraying paint on to substantially horizontal surfaces an uneven spray pattern can be produced because the gun cannot be held so that the nozzle is at a right angle to the surface to be painted. If the gun is held at a right angle to the surface to be painted, paint cannot be drawn out of the container. It is therefore necessary to direct the gun at an angle of not more than 60 degrees to the surface being sprayed but this causes the spray pattern to be uneven.

An example of the second category of spraying equipment comprises a hose extending from a remote supply of pressurised air, the hose having a gun at the free end thereof on which there is mounted a container filled with paint. The gun is similar to the type described above insofar as air is used to draw paint through the gun, but the orifices tend to be smaller. In order to draw the paint through the gun the air must be pressurised to a high pressure, and must be held in a pressurised vessel.

The third category of spraying equipment is a variation of the second. A high pressure system pressurises the paint and the gun has a nozzle that can be opened or closed to permit or prevent the fluid passing through the nozzle. The paint need not be held in a pressurised vessel but can be held in an open container from which it is drawn by pumping means. It is then pressurised in the hose to very high pressures.

Although these types of sprayer generate sufficient pressure to spray viscous substances such as emulsion paints, the apertures in the nozzle of the gun tend to be much smaller than the apertures in the nozzles of the guns used with high volume low pressure systems. This can lead to the apertures becoming blocked with paint.

Another problem associated with high pressure low volume sprayers is that the paint hits the surface to be coated at such a high velocity that some of the paint bounces off the surface. Not only does this contaminate the air space in which the spraying is being carried out, but also objects other than the object at which the spray is aimed are covered in paint. Additionally, high pressure low volume spraying equipment tends to be heavy and difficult to manoeuvre.

Guns used with spraying equipment often provide for regulating the degree to which the liquid outlet may be opened. Prior art guns rely on adjusting the position of a spring against which an obturating member is moved to achieve this regulation. However, this adversely affects the feel of the trigger.

It would therefore be desirable to provide spraying equipment which does not suffer from the above-mentioned disadvantages.

It would also be desirable to provide a gun which does not suffer from the problems encountered by available guns.

SUMMARY OF INVENTION

The invention provides spraying equipment comprising a spray head, a liquid supply, pumping means, and a pressurised air generating means, wherein pressurised air is delivered to the head and passes out of at least one air outlet nozzle in the barrel thereof, and wherein the pumping means delivers liquid from the liquid supply to the head, the head being provided with a liquid outlet through which the liquid passes, wherein the or each said air outlet nozzle is substantially adjacent to the liquid outlet, a region of low pressure created by the outflow of air drawing the liquid through the liquid outlet and atomising the said liquid.

Suitably, a pipe extends from the pumping means to the head. The pumping means preferably comprises a pump which is independent of the air supply, such as gear or a peristaltic pump. Advantageously, the pumping means comprises a feed screw surrounded by a shroud, the feed screw being rotated by drive means. Preferably, the liquid supply comprises a liquid-containing receptacle, and the feed screw extends downwardly into the receptacle. The feed screw may be a helical screw. The drive means may comprise a motor, which may be an electric motor.

The pump speed may be controllable to vary the flow rate between 0.2 and 5.0 litres per minute of liquid, and preferably delivers 0.2 to 1.0 litres per minute of liquid. The amount of fluid delivered by the pump depends on the viscosity of the fluid.

In one embodiment of the invention the pressurised air pressurises the liquid contained in the receptacle.

Preferably, the air pressurising means comprises a fan, which may be a centrifugal fan. Suitably, a motor is provided to drive the fan. The pressurising means may generate air pressurised to between 0.13 and 0.5 bar, and advantageously generates air pressurised to 0.2 bar.

Advantageously, a housing is provided on which is mounted the said receptacle, the pumping means and the pressurised air generating means, the housing being provided with an air inlet, and an air outlet, the pressurised air generating means drawing air through the inlet and directing the pressurised air into a chamber in which the outlet is mounted. Preferably, the chamber is provided with a tapping into the receptacle, thereby providing for pressurisation of the liquid supply.

The receptacle may be removably mounted on the housing, and may comprise at least one resilient member which co-operates with a protrusion on the housing to secure the receptacle thereto. The mounting of the receptacle on the housing may be substantially airtight.

A flexible hose may be provided to deliver air from the air outlet of the housing to the spray head. The said liquid delivery pipe may be located within the said hose.

The housing may be provided with a handle.

Advantageously, the housing is provided with a shoulder strap to enable the device to be carried by the sprayer operator during the course of spraying.

Preferably, the head is provided with control means to control the outflow of liquid from the gun. The control means may comprise an obturating member to open or close the liquid outlet. The obturating member may be a pin. The control means may comprise biasing means to bias the obturating member into a position in which the liquid outlet is closed, and the biasing means may comprise a spring. Advantageously, the spray head is a hand-held spray gun and the control means comprises a trigger to move the obturating member between the closed and open positions.

The control means may be provided with adjustment means to adjust the degree to which the obturating member may be moved away from the liquid outlet when the said member is moved to the open position. The adjustment means may comprise a stop member which limits the movement of the trigger, thereby limiting the degree to which the obturating means is moved.

The invention also provides a pressurised fluid operated spray device adapted to be connected to a source of pressurised fluid and to a liquid adapted to be pumped to a liquid outlet located adjacent a pressurised fluid outlet provided in the spray device, an obturating member movably mounted in the device between liquid outlet open and closed positions in response to operation of a trigger mechanism effective to move the obturating member from the closed position to the open position.

The trigger mechanism may comprise a variable stop member which is selectively adjustable to restrict the extent of movement of the trigger and thereby the extent of movement of the obturating member.

The obturating member may be slidably mounted in a bore, and a spring may be provided to bias the said member into the closing position. The obturating member may comprise a pin. The stop member may be slidably mounted in a grip portion of the gun, and the adjuster may comprise a rotatably mounted shaft which co-operates with the stop member to produce movement of the stop member in the axial direction thereof upon rotation of the adjuster.

The diameter of the liquid outlet and the obturating means may be chosen to suit the viscosity of the liquid being sprayed.

Preferably, the pressurised fluid is air. The primary product may be a liquid such as paint.

The invention also provides pressurised fluid operated liquid spraying equipment comprising a housing incorporating a removable container for liquid to be sprayed, pumping means for delivering liquid in said container to a liquid outlet, pressurised fluid generating means providing a source of pressurised air at a pressurised air outlet, said housing further having means whereby said liquid outlet and said pressurised air outlet may be connected to a spray gun such that pressurised air delivered by said pressurised air generating means can entrain liquid pumped by said pumping means whereby to atomise said liquid.

Another aspect of the invention provides a method of spraying paint using spraying equipment according to the invention.

The spraying equipment of the invention is easily portable and enables viscous liquids, such as emulsion paints to be sprayed. This is achieved by pumping the liquid to the gun and by using pressurised air to draw the liquid through the liquid outlet nozzle. By pressurising the liquid supply, the equipment is made even more effective.

The gun of the invention allows the degree to which the liquid outlet is adjusted to be varied without altering the degree to which the biasing means is compressed prior to depression of the trigger. This is advantageous because the trigger always feels the same, irrespective of the distance through which the obturating means is to be moved.

It will be appreciated that, while reference has been made to the spraying of paint, the spraying equipment of the invention is suitable for spraying a wide range of liquids, including thixotropic liquids and emulsions. Also, the spraying equipment, while described with reference to hand-held use, is readily adapted for use in industrial spraying, with the control of the flow of liquid being effected remotely, for example by the use of electromechanical, pneumatic or hydraulic control systems.

BRIEF DESCRIPTION OF THE DRAWINGS

In the drawings, which illustrate exemplary embodiments of the spraying equipment according to the invention.

DETAILED DESCRIPTION OF THE PREFERRED EMBODIMENTS

Figure 1:
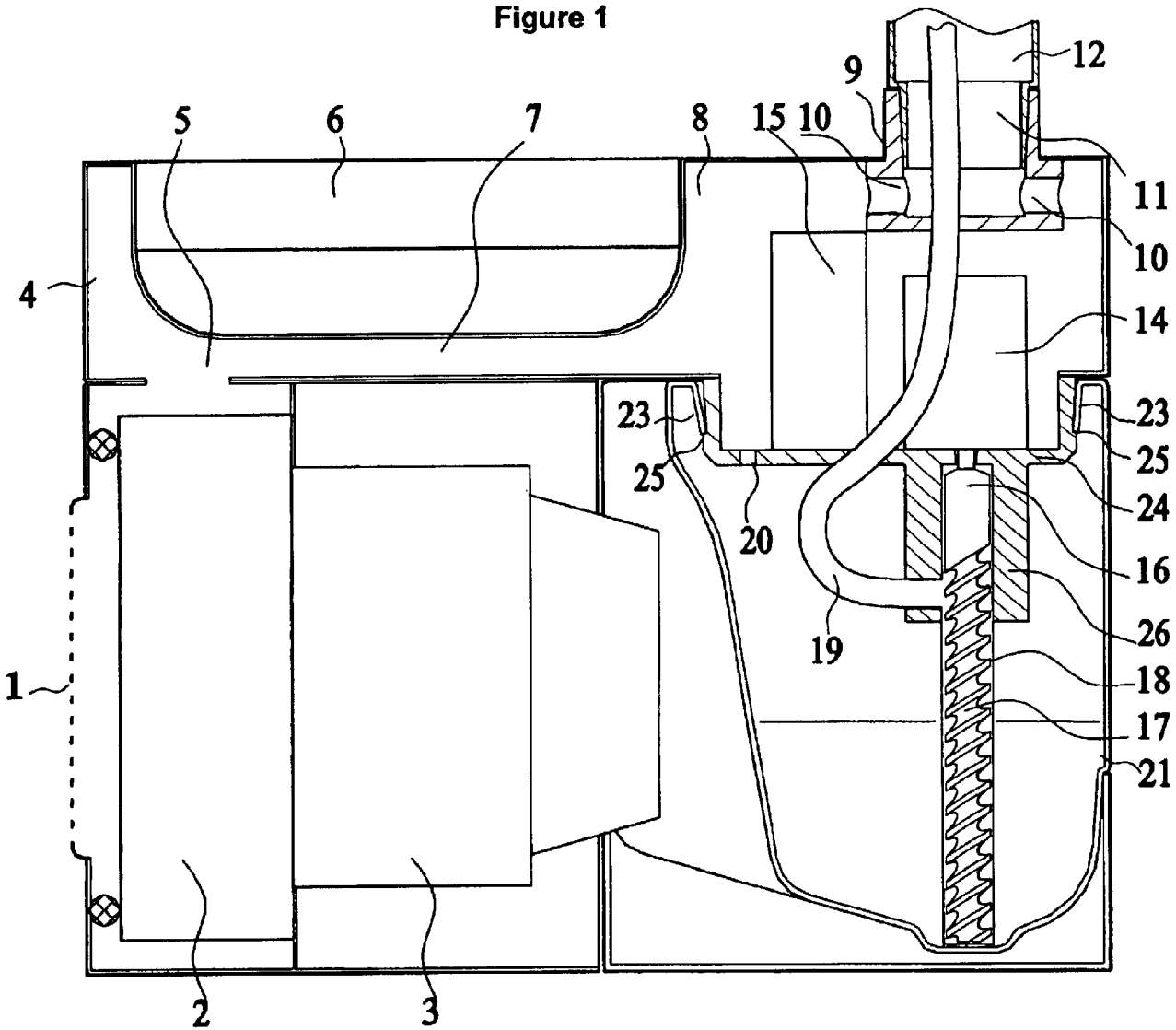
FIG. 1 is a cross-sectional side view of a part of the spraying equipment according to the invention.
Figure 2:
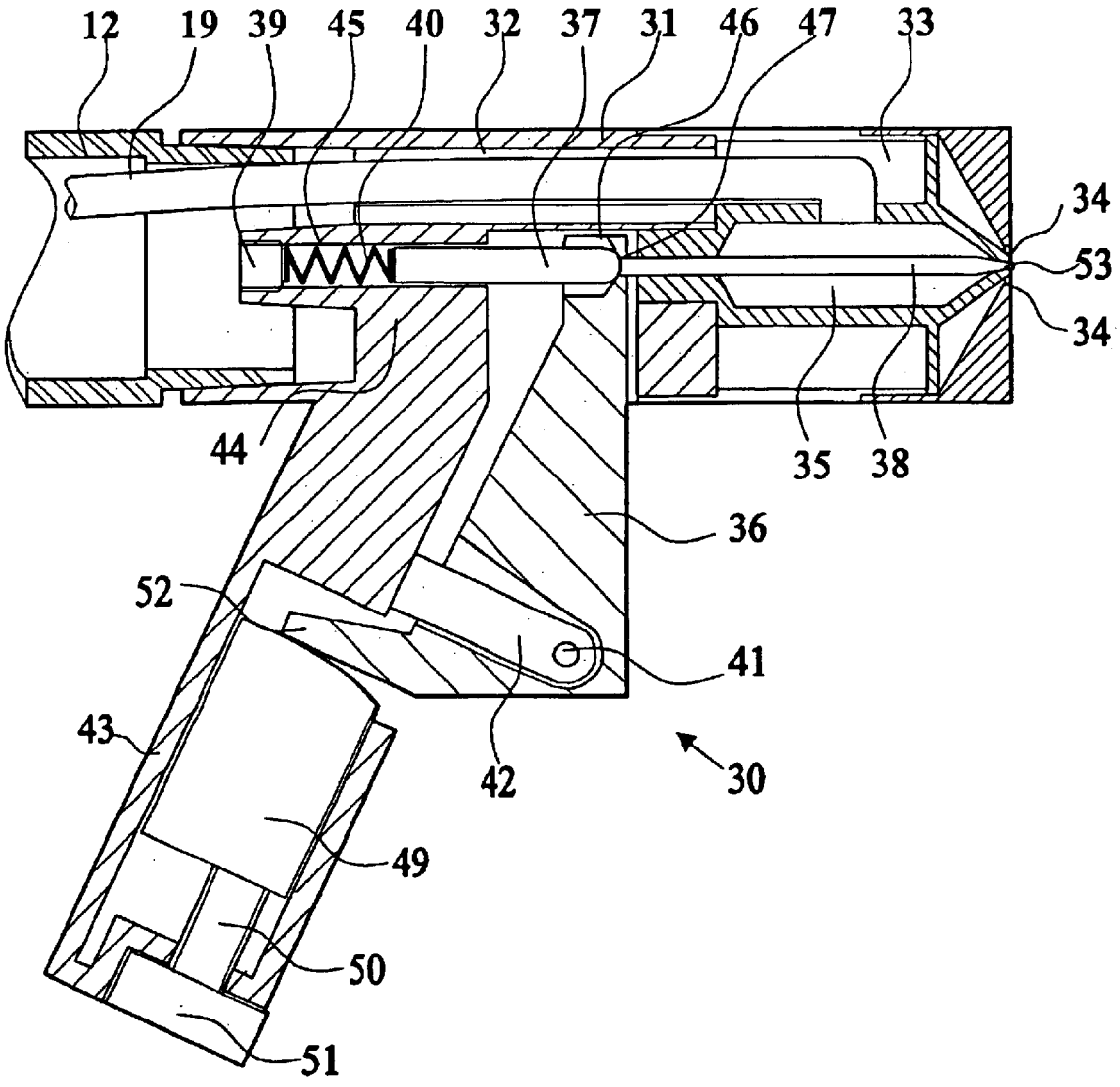
FIG. 2 is a cross-sectional side view of a gun.

Referring now to FIG. 1, there is shown a device for supplying a liquid in the form of paint to a gun as shown in FIG. 2. The device comprises a housing 4 in which a centrifugal fan 2 is driven by a motor 3 is mounted. The fan 2 draws air into the housing 4 through a grill 1. Air is forced out of the fan through an opening 5 into a channel 7. The channel 7 opens out into a chamber 8 at the top of which there is mounted a coupling 9 having a pair of inlets 10 and an outlet 11. One end of a hose 12 is attached to the coupling 9. Attachment is by virtue of the taper on the internal surface of the coupling, and the taper on the end of the flexible hose 12. The flexible hose is simply pushed into the coupling, and is held in place by friction. The other end is attached in the same manner to the gun shown in FIG. 2. A screw or bayonet connector could alternatively be used.

Mounted in the housing 4 is a container fixing boss 24 around the circumference of which extends a lip 25. A container 21 is formed from a plastics material, and the upper circumferential edge thereof is turned back into the container, to form a resilient attachment member 23 which moves inwards towards the outer wall of the container when the container is being attached to the fixing boss 24. When the bottom edge 25 of the attachment member 23 passes over the lip 25, it engages therewith to secure the container to the fixing boss 24. To remove the container 21 from the fixing boss 24, a lever is inserted between the attachment member 23 and the fixing boss, the lever moving the attachment member out of engagement with the lip 25.

On the container fixing boss 24 there is mounted a DC motor 14 and a transformer 15. A shaft 16 extends from the motor 14 and is attached to a feed screw 17. The feed screw 17 is a helical conveyor and is surrounded by a tubular member 18. Extending downwardly from the base of the container fixing boss 24 is a housing 26 which surround the upper portion of the feed screw 17. The housing has an aperture therein to which a pipe 19 is attached. As the feed screw 17 is turned paint is pumped from the container 21 and into the pipe 19. The free end of the pipe 19 is attached to the gun shown in FIG. 2. It can be seen from FIG. 1 that the system for pumping paint from the container 21 to the gun is an open system, and as such there is no build up of pressure in the paint release chamber 35. This is advantageous because the contents of the paint release chamber are not expelled immediately upon pulling on the trigger, rather paint flows steadily out of the gun, it being drawn out and atomized by the pressurised air.

It can be seen from FIG. 1 that the container mounting boss is provided with an aperture 20. The chamber 8 is pressurised by the air forced through the opening 5. The container 21 is open to the chamber 8 through the aperture 20, and hence a positive air pressure is exerted on the paint in the container 21 thereby assisting in the pumping of the paint out of the container by the feed screw 17.

Referring now to FIG. 2, there is shown a gun 30 having a barrel 31, an air passageway 32 (which is one of a number of such passageways, one being shown for the sake of clarity) entering into a chamber 33 which has a plurality of air outlets 34. Mounted in the air passageway 32 is the free end of the pipe 19. The end of the pipe 19 is connected to a paint release chamber 35 having an outlet 53 which is opened and closed by one end of a rod 38 which is pointed. The rod 38 extends from a piston 37 which is slidably mounted in a bore 45 in block 44. The end of the bore 45 is sealed with a removable threaded plug 39. A spring is mounted in the bore 45 between the plug 39 and the piston 37, the spring forcing the rod 38 into a position in which it closes the paint chamber outlet 53.

The diameter of the paint chamber outlet 53 and the pin 38 may be chosen to suit the viscosity of the paint being sprayed.

The gun 30 comprises a pistol grip 43 to which a bracket 42 is attached. A pin 41 pivotally attaches the trigger 36 to the bracket 42. One end of the trigger is provided with an aperture 47 through which the rod 38 passes. In the region of the aperture 47 there is a cut away portion 46, the rearward side of the cutaway portion engaging with the piston 37. When the trigger 36 is pulled back the piston 37 slides backwards in the bore 45 compressing the spring 40, and the rod is withdrawn from the paint chamber outlet 53. Since the paint in the pipe 18 is pressurised due to the pumping effect of the feed screw 17 and the air pressure exerted on the paint in the container 21, the paint is forced out of the paint release chamber outlet 53. Around the paint release chamber outlet 53 is a plurality of air outlets 34. Air passing through these outlets produces a region of low pressure which draws the paint out of the paint release chamber and subsequently atomises the paint.

When using different types of paint it is necessary to open the paint release chamber outlet 53 by differing degrees. Mounted in the grip 43 is an adjustment means comprising a rotatably mounted threaded shaft 50 having a grip portion 51 at one end thereof. An adjustment block 49 is slidably mounted in the grip 43 and is provided with an internally threaded bore with which the threaded shaft 50 co-operates. The adjustment block 49 cannot rotate, and hence when the grip portion 51 is turned, the block 49 moves up or down in the grip 43.

The trigger 36 has a foot portion 52 which abuts the upper surface of the block 49 to limit the trigger's movement. The effect of moving the block 49 is to alter the degree to which the trigger 36 can move. However, this is done without changing the degree to which the spring 40 is compress when the rod 38 is in its closing position.

The process of spraying according to the invention comprises the steps of:

a) activating the motor 3 to drive the fan, thereby driving air through the duct 7 into chamber 8 and through the pipe 12 to the gun 30, the air exiting through apertures 34 in one end of the gun barrel 31;

b) exerting a positive pneumatic pressure on paint in the container 21;

c) activating feed screw 17 to pump paint out of the container 21 to the gun 30; and d) retracting trigger 36 to withdraw rod 38 from the paint release chamber outlet, thereby permitting release of paint from the gun.

The feed for the paint or other liquid may be adjustable so as to vary the flow rate of liquid delivered by the system.

What is claimed is:

1. Spraying equipment comprising a spray head, container for liquid to be sprayed, pumping means for pumping liquid from said container to a liquid outlet adjacent at least one pressurised air outlet nozzle provided in said spray head, and pressurised air generating means for delivering a flow of pressurised air through said at least one air outlet nozzle so as to entrain liquid delivered by said pumping means to said liquid outlet, thereby to atomize said liquid, characterised in that the pumping means comprises feed screw adapted to extend into said liquid container and coupled to drive means for driving said feed screw.

2. Spraying equipment as claimed in claim 1, wherein the feed screw comprises a helical screw rotatably mounted within a shroud adapted to extend into said liquid container means, and said drive comprises an electric motor.

3. Spraying equipment as claimed in claim 1, wherein said pressurised air generating means comprises a fan coupled to a drive motor.

4. Spraying equipment as claimed in claim 1, wherein said liquid container, pressurised air generating means and pumping means are mounted in a housing separate from said spray head, said housing also having an air inlet adapted to supply air to said pressurised air generating means, a chamber for receiving pressurised air from said pressurised air generating means, and a pressurised air outlet connected to said chamber and adapted to be coupled to said spray head.

5. Spraying equipment as claimed in claim 4, further comprising an air-way between said chamber and said liquid container, whereby to pressurise liquid in said liquid container so as to assist delivery of liquid to said liquid outlet by said pumping means.

6. Spraying equipment as claimed in claim 5, wherein said liquid container comprises a receptacle adapted to be removably mounted to said housing, the receptacle having a resilient portion for co-operation with a protrusion on said housing.

7. Spraying equipment as claimed in claim 4, further comprising a flexible hose for coupling pressurised air from said housing to said spray head, and a pipe for carrying liquid from said pumping means to said liquid outlet in said spray head.

8. Spraying equipment as claimed in claim 1, wherein control means are provided on said spray head to regulate the flow of liquid to said liquid outlet.

9. Spraying equipment as claimed in claim 8, wherein said control means comprise an obturating member, adapted to regulate the size of the liquid outlet in response to operation of a control on the spray head.

10. Spraying equipment as claimed in claim 9, wherein the control on the spray head is a manual control.

11. Spraying equipment as claimed in claim 9, wherein the control on the spray head is a remotely-operated control.

12. Spraying equipment as claimed in claim 10, wherein, said obturating member comprises a pin slidable within a bore terminating in said liquid outlet, said pin being spring-biased towards a liquid outlet closed position, and said control comprises a trigger coupled to move said pin from said closed to an open position.

13. Spraying equipment as claimed in claim 12, further comprising variable stop means on said spray head selectively adjustable to restrict the extent of movement of said trigger, whereby to limit the degree of opening of the liquid outlet.

* * * * *